US006725870B1

(12) United States Patent
Lo

(10) Patent No.: US 6,725,870 B1
(45) Date of Patent: Apr. 27, 2004

(54) SIMPLE HANGING PARASOL

(76) Inventor: Albert Chong-Jen Lo, 3023, Windy Knoll Ct., Rockville, MD (US) 20850

( * ) Notice: Subject to any disclaimer, the term of this patent is extended or adjusted under 35 U.S.C. 154(b) by 42 days.

(21) Appl. No.: 10/252,671

(22) Filed: Sep. 24, 2002

(51) Int. Cl.[7] ..... A45B 11/00
(52) U.S. Cl. ..... 135/20.1; 135/98; 135/21; 135/20.3
(58) Field of Search ..... 135/90, 98, 20.1, 135/20.3, 21, 23

(56) References Cited

U.S. PATENT DOCUMENTS

| | | | | | |
|---|---|---|---|---|---|
| 604,275 | A | * | 5/1898 | Stover | 135/23 |
| 4,606,366 | A | * | 8/1986 | Collet | 135/20.1 |
| 5,937,882 | A | * | 8/1999 | Harbaugh | 135/20.3 |
| 6,152,156 | A | * | 11/2000 | Tung | 135/21 |
| 6,196,242 | B1 | * | 3/2001 | Xu | 135/20.1 |
| 6,401,735 | B1 | * | 6/2002 | Chou | 135/20.1 |
| 6,401,739 | B1 | * | 6/2002 | Bright et al. | 135/98 |

FOREIGN PATENT DOCUMENTS

DE 4407188 * 12/1994

* cited by examiner

*Primary Examiner*—Winnie S. Yip
(74) *Attorney, Agent, or Firm*—Bacon & Thomas, PLLC

(57) ABSTRACT

A simple hanging parasol includes a hanging shank, and a parasol body combined beside the shank. The shank has a fix base fixed on top, a slide sleeve fitting movably around the shank. The parasol body has a plurality of ribs, a plurality of spreaders, a canopy, an upper ring, a lower ring, and an elastic pulling member. The ribs have inner ends pivotally connected radially with the upper ring located at the center of the canopy and one outer end pivotally connected with the slide sleeve. The lower ring has a tubular member to fit with a conical insert rod of the upper ring to keep the ribs expanded to support the canopy in expanding the parasol, and to separate from the insert rod in collapsing the parasol to lie along beside the shank. The pulling member pulls the lower ring to let the tubular member of the lower ring automatically fit with the insert rod of the upper ring in expanding the parasol.

1 Claim, 8 Drawing Sheets

SIMPLE HANGING PARASOL

BACKGROUND OF THE INVENTION

This invention relates to a simple hanging parasol, particularly to one provided with an upper ring and a lower ring to be automatically fitting with each other in expanding or collapsing a canopy in conjunction with a elastic pulling member provided between the lower ring and one of spreaders, so as to conveniently handle the parasol.

A conventional hanging parasol shown in FIGS. 1 and 2, includes a hanging shank 1 and a parasol body 2 supported by the hanging shank 1. Then the shank has a fix base 11 fixed on top of the shank 1 and a slide sleeve 12 fitting movably around the shank 1 below the fix base 11. The shank 1 has its lower end fixed firmly on the ground or the like. The parasol body 2 consists of a plurality of ribs 21, and a plurality of spreaders 22, an upper ring 24, and a lower ring 25 and a canopy 23 supported on the ribs 21. The ribs 21, 21*a* have their upper ends pivotally connected to the upper ring 24 positioned in the center of the canopy 23 in radial condition, and the upper ring 24 has its lower end connected with a conical insert rod 241, which has a stop lip 2410 formed in an intermediate portion. The lower ring 25 is located under the upper ring 24 and pivotally connected with inner ends of the spreaders 22, 22*a* in a radial condition. The spreaders 22, 22*a* have their outer ends pivotally connected to intermediate portions of the ribs 21, 22*a*. The lower ring 25 has a tubular base 251 formed to extend upward from an upper end, and the tubular base 251 may be inserted by or separated from the insert rod 241 of the upper ring 24 in case of expanding or collapsing the parasol body 2.

One of the ribs 21*a* and one of the spreaders 22*a* intercross with each other and pivotally connected with each other, with the outer end of the rib 21*a* pivotally connected with the slide sleeve 12 of the shank 1, and with the outer end of the spreader 22*a* is pivotally connected with the fix base 11, as shown in FIG. 1. Therefore, the rib 21*a* and the spreader 22*a* combine the parasol body 2 with the shank 1, and prop up the whole weight of the parasol together.

In using the conventional parasol, if the slide sleeve 12 is moved manually down along the shank 1 from an expanded condition shown in FIG. 1 to a collapsed condition shown in FIG. 3, the rib 21*a* may forces the other ribs 21 and all the spreaders 22, 22*a* swing down to move nearer to the shank 1 and finally lie along the shank 1 in a collapsed condition (as shown in FIG. 3).

On the contrary, if the slide sleeve 12 is manually moved up along the hanging shank 1 from the collapsed condition to the expanded condition, forcing the tubular base 251 insert in the insert base 241, with the upper end of the tubular base 251 contacting (or stopped by) the stop lip 2410 to let the canopy 23 expanded on the ribs 21, 21*a*. Then the conventional hanging parasol is completely expanded for use, as shown in FIG. 1.

However, the conventional hanging parasol has been found to have a drawback that the upper ring 24 and the lower ring 25 often cannot align to each other as to fit with each other in an expanding course. Then another person has to help correct the upper and the lower ring 24 and 25 to align to each other in fitting with each other. Thus, a user cannot use the conventional hanging parasol without assistance of another person, quite inconvenient.

The cause of the drawback of the conventional hanging parasol is to be described. As shown in FIG. 4, the whole weight of the conventional hanging parasol is supported only one of the ribs 21*a* and one of the spreaders 22*a* connected with the hanging shank 1, in a suspended condition. So when the slide sleeve 12 is moved nearer to the upper end of the shank 1 and to expand the canopy 23, the whole parasol is located at the farthest from the shank 1, in other words, the whole parasol is at the farthest distance from the shank 1, and all the ribs 21 and all the spreaders 22 may sag to make the upper ring 24 and the lower ring 25 all tilted for an angle. Then the lower ring 25 is supported by the spreader 22A in a horizontal condition, and liable to tilt outward from the shank 1. But the upper ring 24 is supported by the sloped rib 21*a*, and liable to tilt toward the shank 1 as shown in FIG. 4A. So the tilting directions of the upper and the lower ring 24 and 25 are opposite to each other, impossible to the both 24 and 25 fit with each there. However, a user has to slide up the slide sleeve 12 with one hand and to grip the shank 1 with the other hand, impossible to adjust the upper and the lower rings 24 and 25. Then the user needs another person to help adjust them to fit with each other as shown in FIGS. 1 and 2, making up an annoying problem.

SUMMARY OF THE INVENTION

This invention has been devised to offer a simple hanging parasol expansible by only one person, with an upper and a lower ring automatically fitting with each other and thus convenient to use.

The feature of the invention is an elastic pulling member provided to have its outer end hooked with one spreader pivotally connected to a fix base fixed on top of a hanging shank. When the parasol is expanded from a collapsed condition to an expanded condition by manually moving up a slide sleeve fitted movable around the hanging shank, the slide sleeve moves up that spreader with other spreaders and all ribs supporting a canopy, and the ribs have inner ends pivotally connected to an upper ring located at the center of the canopy and intermediate portions pivotally connected with outer ends of the spreaders expanded to the expanded condition, with help of the elastic pulling member automatically resiliently let a tubular member of a lower ring pivotally connected with inner ends of all spreaders to fit with a conical insert rod of the upper ring so as to keep the parasol in the expanded condition stably.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
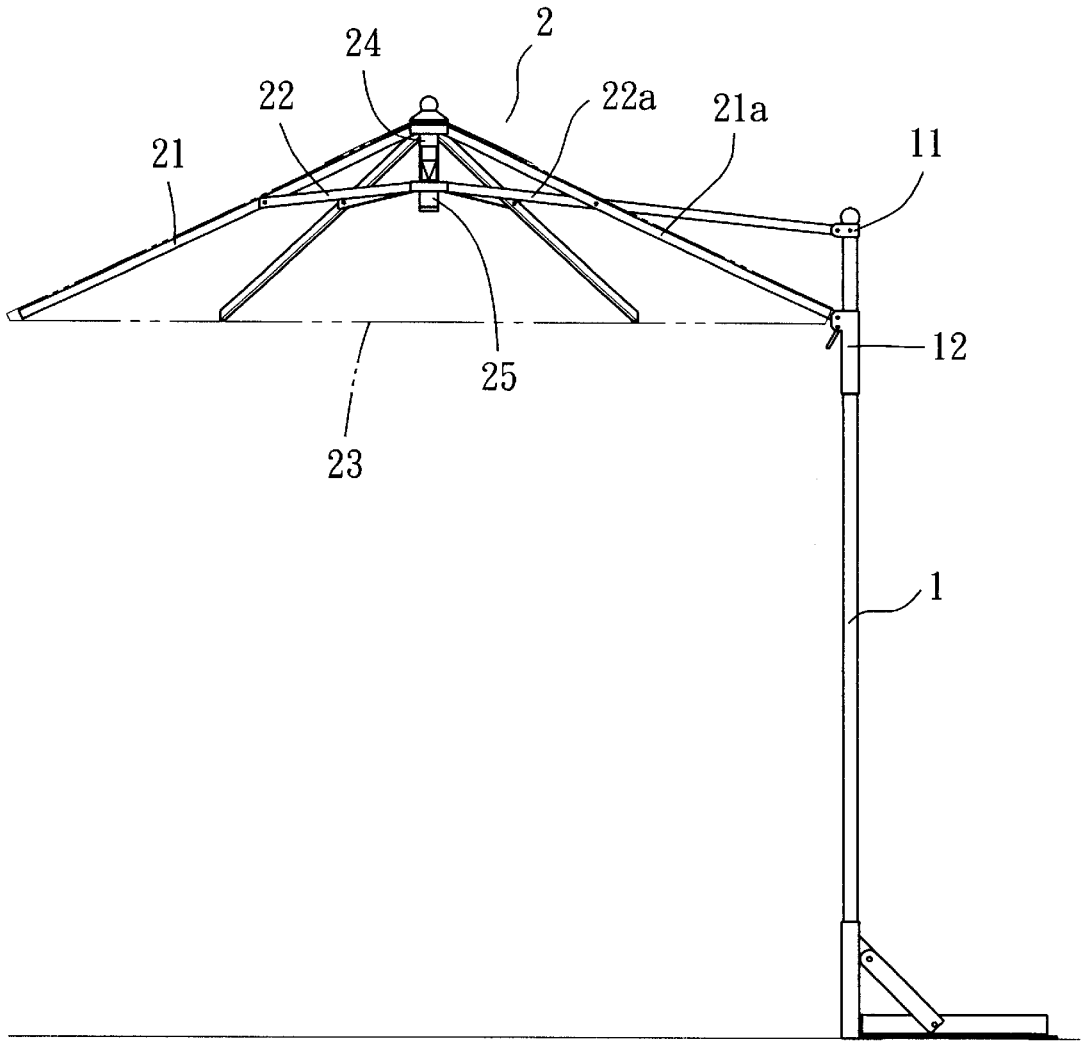
FIG. 1 (PRIOR ART)
FIG. 1 is a side view of a conventional hanging parasol in an expanded condition.
Figure 2:
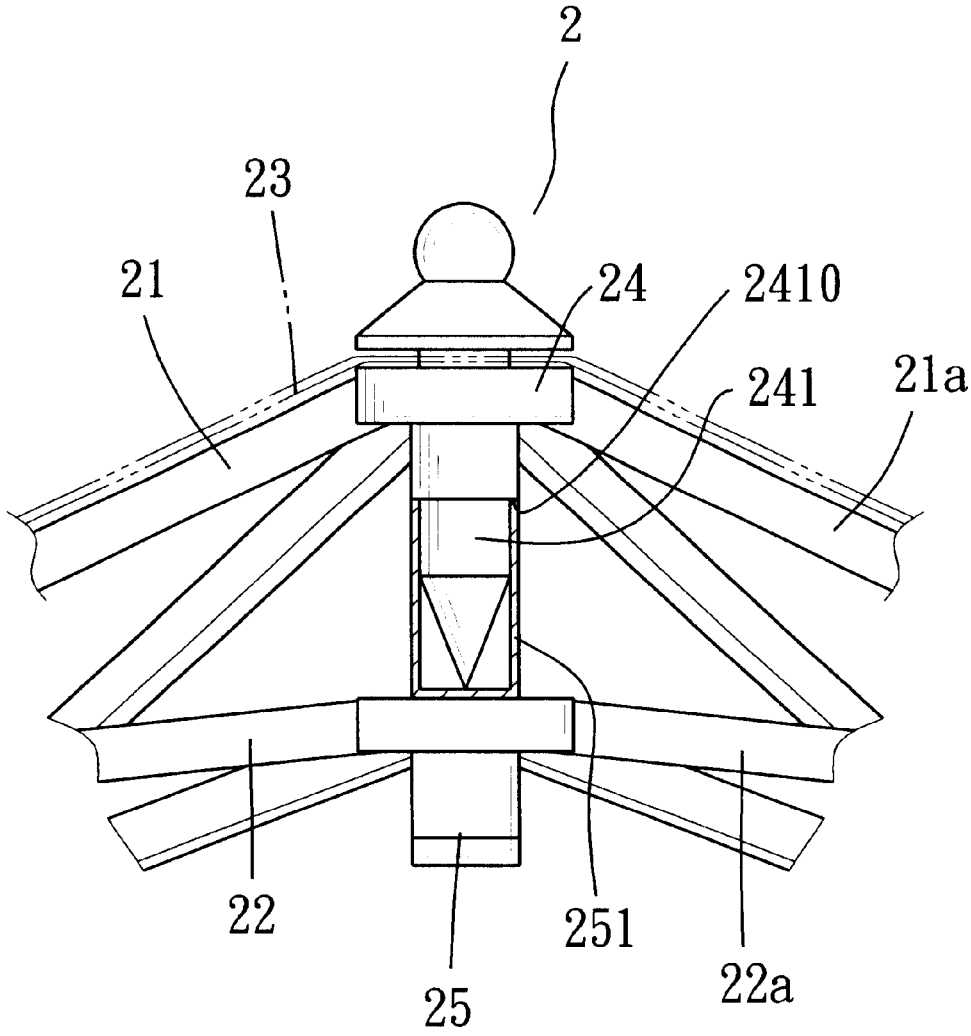
FIG. 2 (PRIOR ART)
FIG. 2 is a magnified partial view of the conventional hanging parasol.
Figure 3:
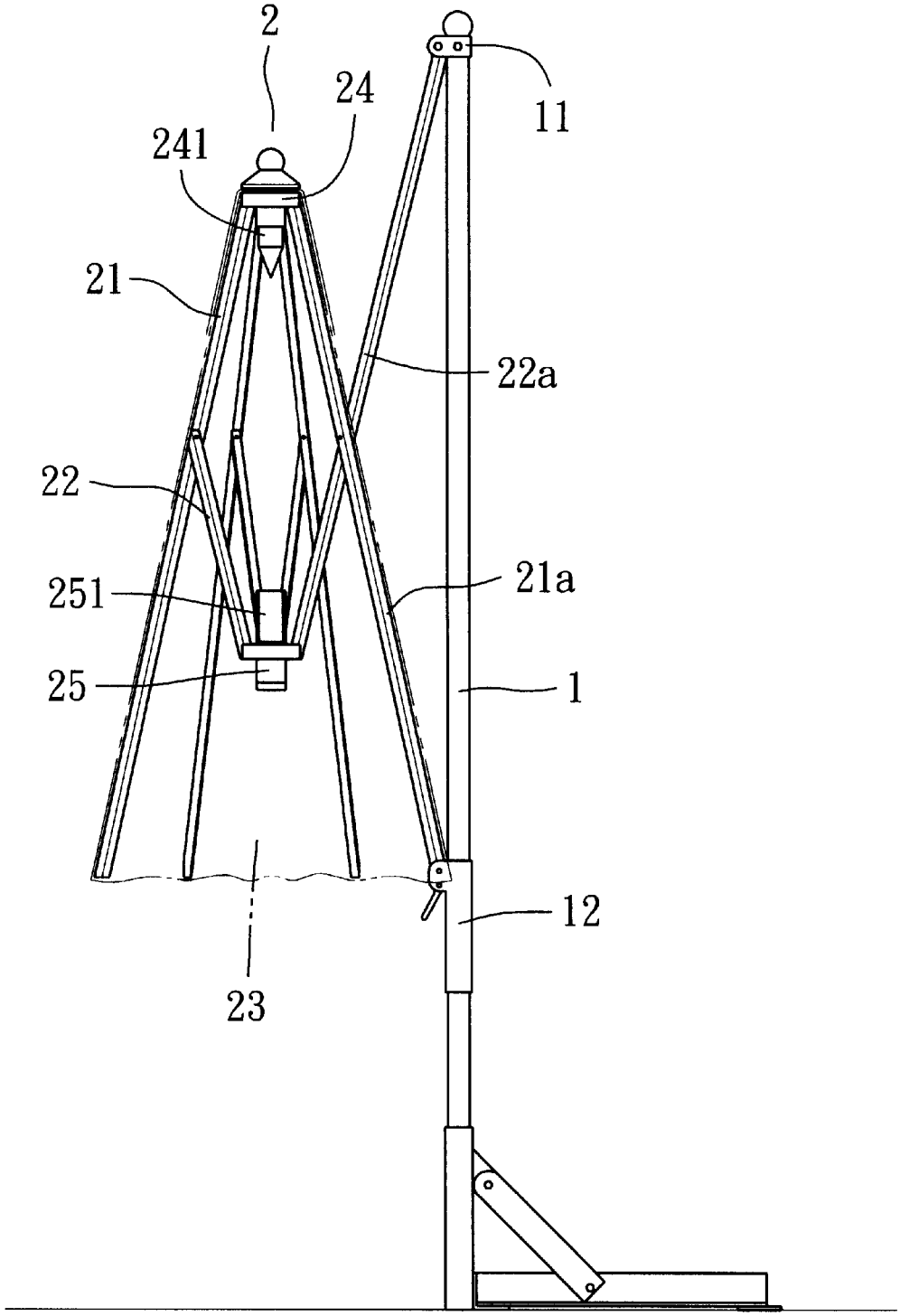
FIG. 3 (PRIOR ART)
FIG. 3 is a side view of the conventional hanging parasol in a collapsed condition.
Figure 4A:
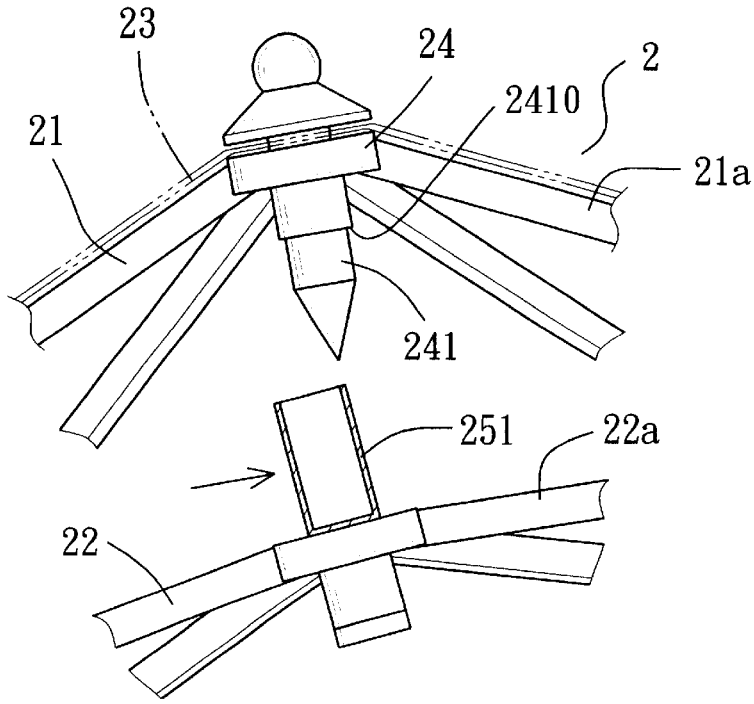
FIG. 4A (PRIOR ART)
FIGS. 4A and 4B are partial front views of the conventional hanging parasol, showing the relative condition of an upper and a lower ring in handling.
Figure 4B:
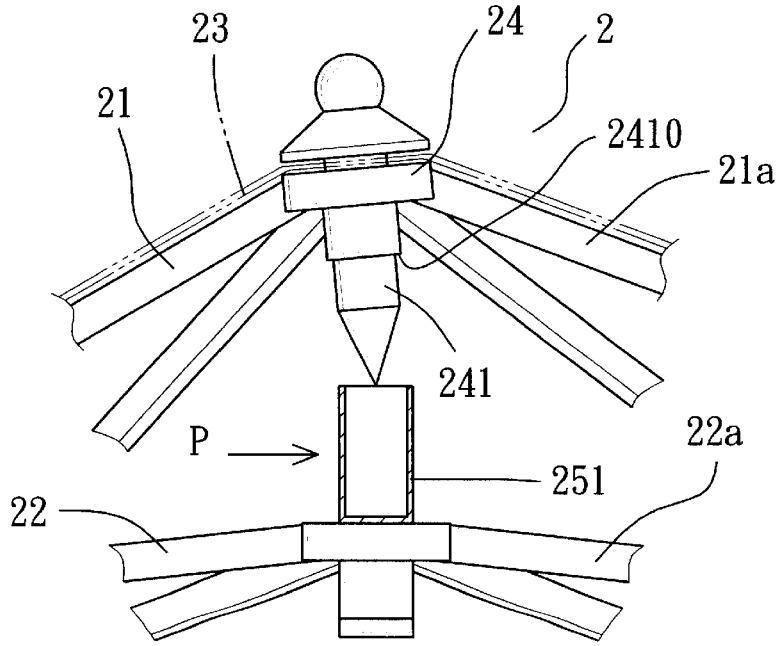
FIG. 4B (PRIOR ART)
Figure 5:
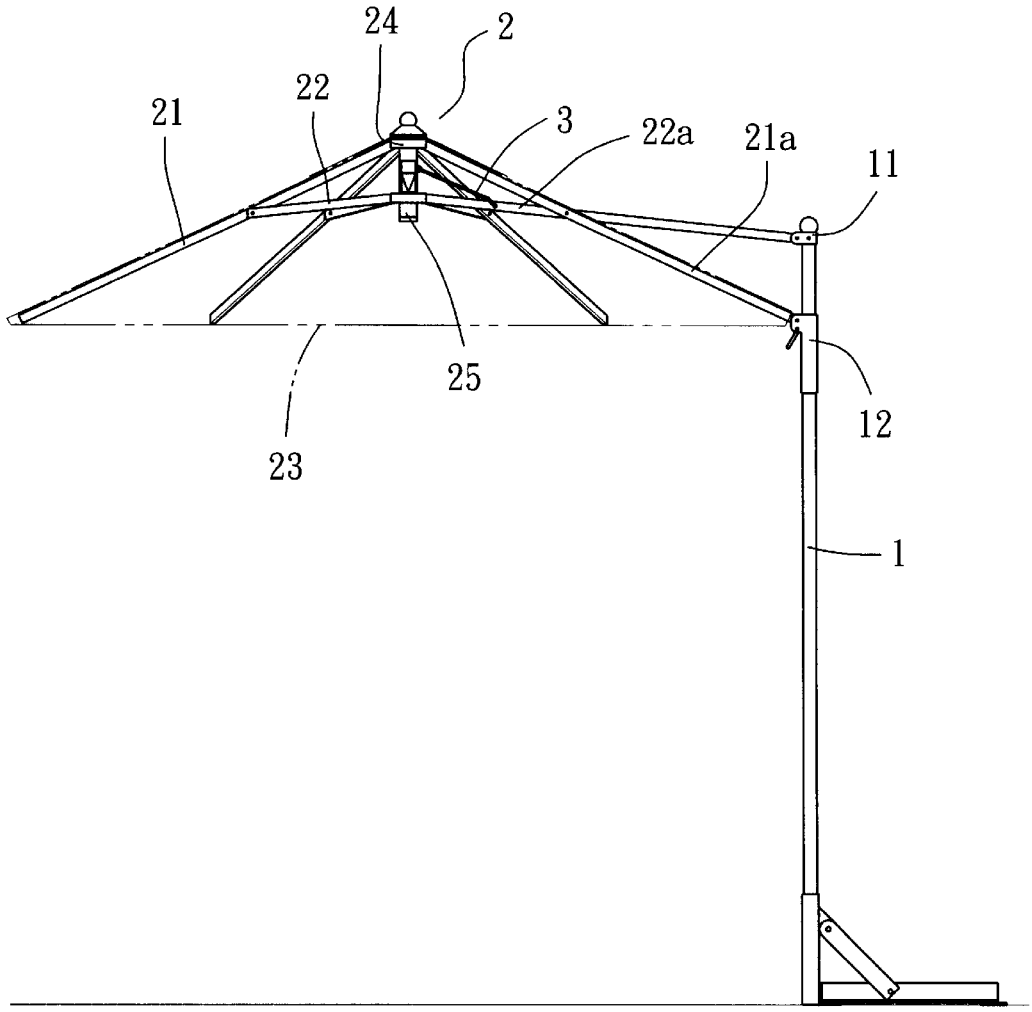
FIG. 5 is a side view of a simple hanging parasol in an expanded condition in the present invention.
Figure 6:
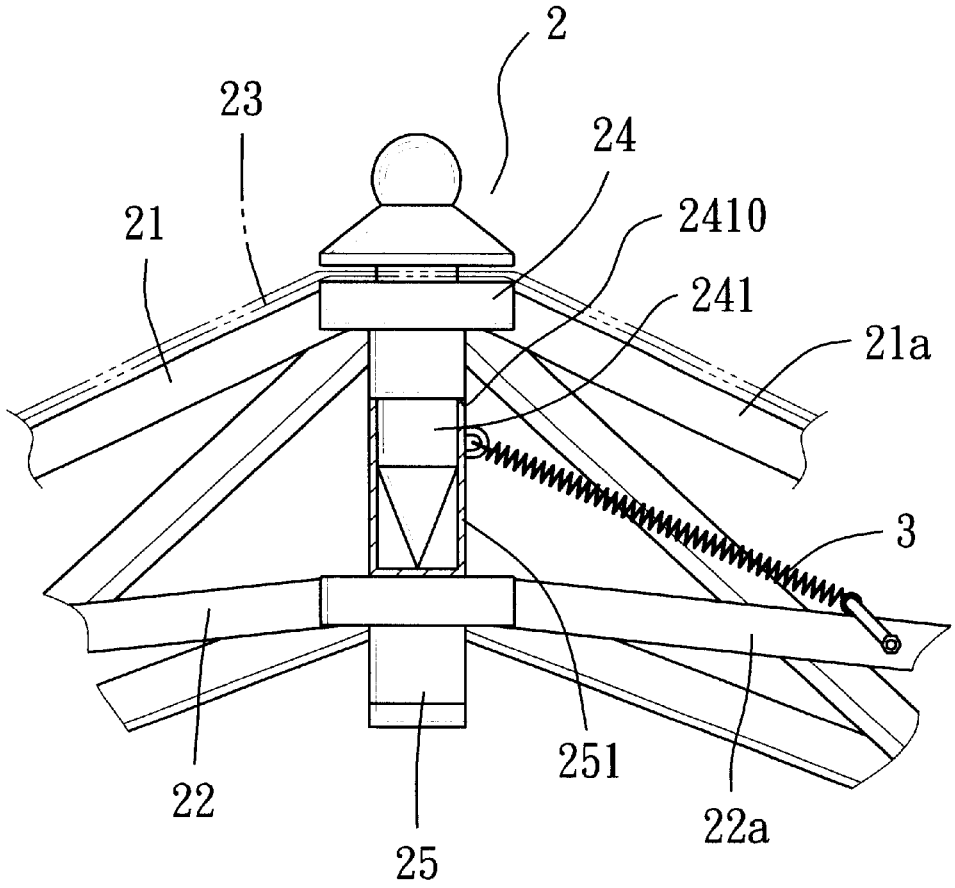
FIG. 6 is a magnified partial view of FIG. 5.

A preferred embodiment of a simple hanging parasol in the present invention, as shown in FIGS. 5 and 6, includes a hanging shank 1, a parasol body 2 positioned beside the shank 1 and connected with the shank 1, and a elastic pulling member 3 combined together. The hanging shank 1 has a fix base 11 fixed on top, and a slide sleeve 12 fitting movable around the shank 1 a little below the fix base 11, The parasol body 2 consists of a plurality of ribs 21, a plurality of spreaders 22, and a canopy 23, an upper ring 24 positioned at the center of the canopy 23, and a lower ring 25 positioned under the upper ring 24, and the elastic pull member 3.

The ribs 21 have their inner ends pivotally connected with the upper ring 24 in a radial condition. One of the ribs 21*a* is specially and pivotally connected with the slide sleeve 12 so as to be expanded or collapsed. The upper ring 24 has a conical insert rod 241 formed to extend down. The canopy 23 is laid to cover all the ribs 21, 21*a*. The spreaders 22 have their inner ends pivotally connected with the lower ring 25 in a radial condition. One of the spreader 22*a* is specially elongate and has its outer end pivotally connected with the fix base 11 and intercrosses and pivotally connected with the rib 21*a* as shown in FIG. 5. Further, the other spreaders 22 have their outer ends pivotally connected to intermediate portions of the related ribs 21. The lower ring 25 has a tubular base 251 formed to extend upward for the conical insert rod 241 to fit therein in case of the parasol expanded and separate from the conical insert rod 241 in case of the parasol collapsed. The rib 21*a* is pivotally connected with the slide sleeve 12 as described above. The spreader 22*a* extends to protrude out of the canopy body 23 and connected pivotally with the fix base 11. Thus the rib 21*a* and the spreader 22*a* both support the weight of the canopy 2.

The pull member 3 is elastic, having an outer end hooking the spreader 22*a* and an inner end hooking the tubular base 251 of the lower ring 25, as shown in FIGS. 5 and 6.

Figure 7A:
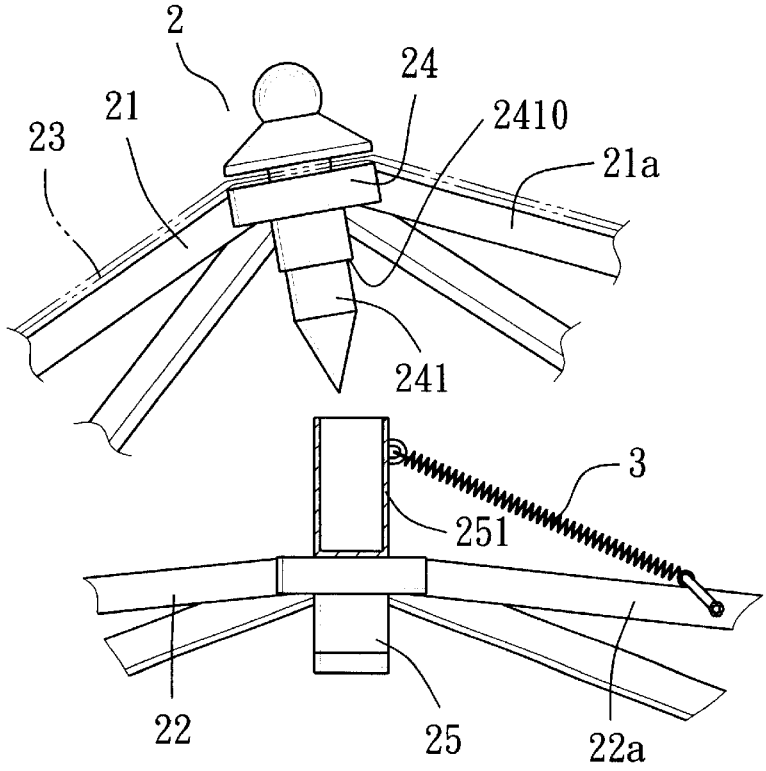
FIGS. 7A and 7B are magnified partial views of an upper and a lower ring in the present invention, showing them being handled; and, FIG. 8 is a side view of another embodiment of a simple hanging parasol in the present invention.
Figure 7B:
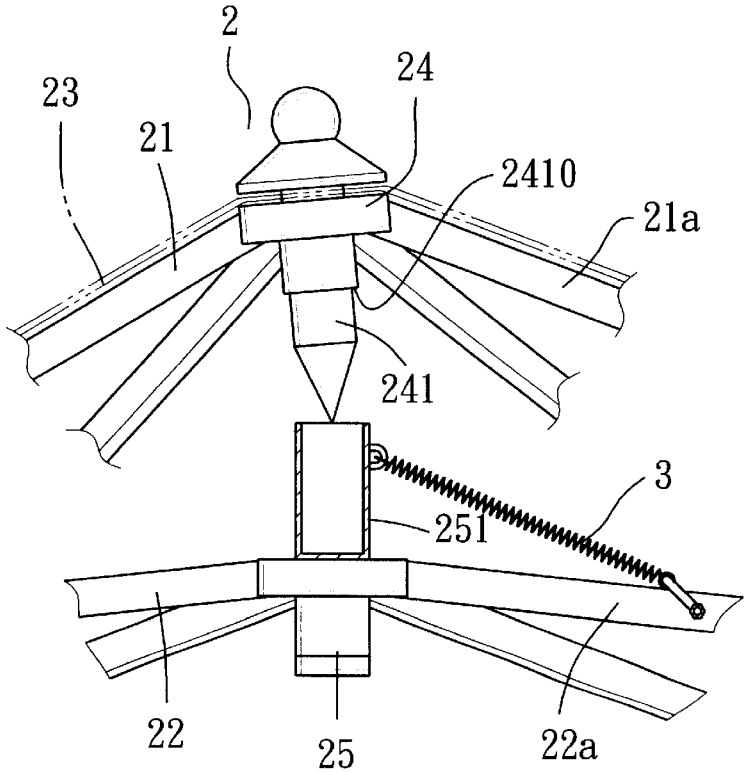

In handling the simple hanging parasol, referring to FIGS. 7A and 7B, when a user expands it, the user manually pushes the slide sleeve 12 in a collapsed position up along the hanging shank 1, with the pull member 3 pulling the lower ring 25 upward to become gradually vertically straight to the shank 1, as shown in FIG. 7A. Then the upper opening of the tubular base 251 of the lower ring 25 is automatically aligned to the conical insert rod 241 and gradually moving up to fit with insert rod 241 to complete expanding of the simple hanging parasol with no assistance of another person.

Figure 8:
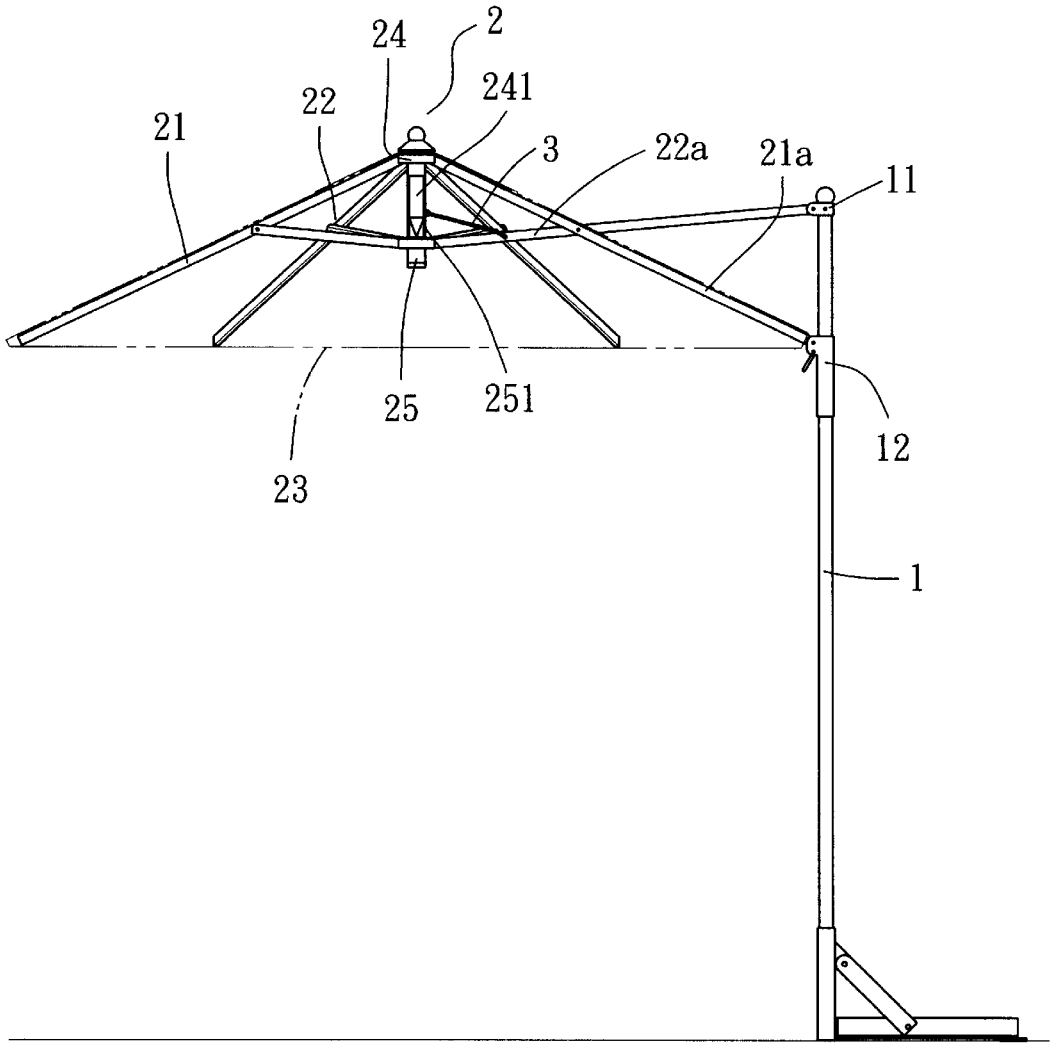

FIG. 8 shows another embodiment of a simple parasol, almost the same structure as the preferred embodiment described above, with the difference that the connecting line of the upper and the lower ring 24, and 25 is higher than the pivotal point of the rib 21*a* and the spreader 22*a* in an expanded position. This embodiment has the same function as the above mentioned preferred embodiment.

While the preferred embodiment of the invention has been described, it will be recognized and understood that various modifications may be made therein and the appended claims are intended to cover all the modifications that fall within the spirit and scope of the invention.

I claim:

1. A simple hanging parasol comprising:

a hanging shank of a proper length with its lower end fixed on the ground or the like;

a fix base fixed on top of said hanging shank;

a slide sleeve fitting movably around said hanging shank a little below said fix base;

a parasol body combined with said hanging shank and positioned beside said hanging shank, said parasol body consisting of a plurality of ribs, a plurality of spreaders, a canopy, an upper ring, a lower ring and an elastic pull member;

said ribs having inner ends pivotally connected radially with said upper ring, one of said ribs having its outer end pivotally connected with said slide sleeve on said hanging shank;

said spreaders having inner ends pivotally connected radially with said lower ring, one of said spreader having its outer end pivotally connected with said fix base on top of said hanging shank, and the other spreaders having their outer ends pivotally connected respectively with intermediate portions of said ribs;

said canopy supported on said ribs;

said upper ring positioned at a center of said canopy and having its outer edge pivotally connected with inner ends of all said ribs in a radial condition, said upper ring having a conical insert rod formed to extend down;

said lower ring positioned under said upper ring and having a tubular member formed to extend up from said lower ring body to fit with said conical insert rod of said upper ring in case of said parasol expanded, said lower ring pivotally connected radially to inner ends of all said spreaders;

one of said ribs pivotally connected with said slide sleeve and one of said spreaders both supporting the weight of said parasol on said hanging shank; and, said elastic pulling member having an outer end hooked with said spreader connected with said fix base and an inner end connected with said tubular member of said lower ring, said pulling member possible to pull said lower ring toward said hanging shank in case of said parasol being expanded, said tubular member of said lower ring automatically aligned to said conical insert rod and gradually fitting with said conical insert rod in expanding course of said parasol so as to keep the expanded condition of said parasol stably.

* * * * *